US005211048A

United States Patent [19]

Takahara et al.

[11] Patent Number: 5,211,048

[45] Date of Patent: May 18, 1993

[54] METHOD OF FORMING SHAPED CONFIGURATION AT END OF LONG ELEMENT

[75] Inventors: Katsuo Takahara, Oota; Shigeru Okajima, Isesaki; Tugio Onodera, Sawa, all of Japan

[73] Assignee: Mitsuba Electric Mfg. Co., Ltd., Gumma, Japan

[21] Appl. No.: 869,207

[22] Filed: Apr. 13, 1992

Related U.S. Application Data

[63] Continuation of Ser. No. 757,228, Sep. 10, 1991, abandoned, which is a continuation of Ser. No. 522,261, May 11, 1990, Pat. No. 5,065,605.

[30] Foreign Application Priority Data

May 17, 1989 [JP] Japan ..... 1-123297

[51] Int. Cl.[5] ..... B21D 45/00

[52] U.S. Cl. ..... 72/344; 72/359; 29/893.34; 470/11; 470/191

[58] Field of Search ..... 72/340, 344, 343, 350, 72/354, 356; 29/843.34; 470/11, 12, 16, 191

[56] References Cited

U.S. PATENT DOCUMENTS

| | | | |
|---|---|---|---|
| 1,855,372 | 4/1932 | White | 10/27 E |
| 2,064,418 | 12/1936 | Kaufman | 10/27 E |
| 3,072,933 | 1/1963 | Carlson | 10/27 E |

FOREIGN PATENT DOCUMENTS

| | | | |
|---|---|---|---|
| 3809191 | 11/1988 | Fed. Rep. of Germany . | |
| 0094749 | 7/1980 | Japan | 10/27 E |
| 0184444 | 9/1985 | Japan | 29/843.34 |
| 0003628 | 1/1986 | Japan | 29/893.34 |
| 61-249642 | 11/1986 | Japan . | |
| 0249642 | 11/1986 | Japan | 29/893.34 |
| 0077144 | 4/1987 | Japan | 72/359 |
| 0273538 | 11/1988 | Japan | 72/343 |
| 1-162535 | 6/1989 | Japan . | |
| 0011241 | 1/1990 | Japan | 72/359 |

*Primary Examiner*—Lowell A. Larson
*Assistant Examiner*— McKeon
*Attorney, Agent, or Firm*—Scully, Scott, Murphy & Presser

[57] ABSTRACT

Disclosed is a method of forming a shaped configuration by cold forging at an end of a long element, such as the armature shaft of a starter motor for an automobile. The die used in this method has an inner space in which a section for forming the shaped configuration is provided at one end portion thereof, and the diameter of the inner space gradually increases from the shaped configuration forming section to the other end portion of the inner space. A material is placed in the die from the other end portion of the inner space and, then, is forced into the die by a punch to be forged into the shape corresponding to that of the inner space of the die. After the forging, the shaped material is pushed out of the die by a knock-out pin which is inserted into the die in the opposite direction to the direction in which the material is forced.

5 Claims, 4 Drawing Sheets

METHOD OF FORMING SHAPED CONFIGURATION AT END OF LONG ELEMENT

This application is a continuation of patent application Ser. No. 757,228, filed Sep. 10, 1991 now abandoned, which is a continuation of application Ser. No. 522,261, filed May 11, 1990, now U.S. Pat. No. 5,065,605.

BACKGROUND OF THE INVENTION

The present invention relates to a method of forming a shaped configuration at an end of a long element by cold forging.

As a long element having a shaped configuration at an end thereof, there is, for instance, the armature shaft of a starter motor for starting the engine of an automobile. Generally used for this armature shaft is a long one having at one end thereof a gear or serrations for driving which are formed coaxially and integrally with the shaft. Such a shaft is preferable to be manufactured by cold forging in view of high accuracy in size and excellence at strength.

FIG. 4 shows an example of the shaft which is generally designated by reference numeral 1. The shaft 1 includes a shaft body 2 and is formed at its end with a gear 3. Hitherto, when manufacturing this shaft 1 by cold forging, a portion 5 of a large diameter is beforehand formed at one end of a material 4 as shown in FIG. 5. Then, as shown in FIG. 6, the gear 3 is cold-forged in the end of the material 4 with a load applied on a stepped face between the large diameter portion 5 and a portion 6 of a small diameter. Alternatively, thought of is a method of placing a metal material in a die which has an inner space corresponding to the shape of the shaft 1 and forcing the material under high pressure by a punch so that the material fills the inner space of the die to be forged into the desired shape. Then, the material thus shaped is pushed out of the die by means of a knock-out pin which is inserted into the die in opposition to the punch.

In the former of the above described methods, however, an extra process is necessary to form the large diameter portion 5. Further, this large diameter portion remains in the completed shaft.

In the case of the latter method, a large frictional resistance produces between the material and the inner surface of the die according as the material extends within the die and, therefore, the forging load inevitably becomes large for surpassing the resistance to force the punch. This brings about a possibility that such defects in forging as scores and the like are caused in the material or the punch breaks down.

In order to reduce the resistance, therefore, a measure of applying a lubricant onto the periphery of the material has been taken when forcing the punch. But, the application of the lubricant gives rise to a disadvantage that the lubricant comes to exist between the material and the die inner surface to deteriorate the accuracy in size.

Moreover, the moving stroke of the knock-out pin for pushing the forged product out of the die has to be equal to, even at the minimum, the length which is necessary for the shaft body 2 to get out of the die, namely the length of the shaft body 2 itself.

Additionally, when pushing the product by the knock-out pin, the whole peripheral surface of the shaft body 2 comes into slide contact with the inner surface of the die to produce a large frictional resistance and, therefore, the load for forcing the knock-out pin also has to be made large, involving the enlargement in size of an apparatus for this end. Thus, the method can not be efficient. Further, the knock-out pin must conform in shape to the teeth of the gear or be smaller in diameter than the root circle of the gear. But, it is costly to form teeth in the knock-out pin all over the length thereof corresponding to its moving stroke in conformity with the teeth of the gear. On the other hand, if forming the knock-out pin of a small diameter, there is a fear that the pressure acting on the pin will increase and the pin will break down.

SUMMARY OF THE INVENTION

It is an object of the invention to provide a method which can form a shaped configuration at an end of a long element by cold forging while solving the above described problems.

Another object of the invention is to provide a cold forging method according which an end of a long element can accurately be formed into a shaped configuration with a small frictional resistance.

According to the invention, there is provided a method of forming a shaped configuration at an end of a long element, which comprises the steps of: placing a material in an inside of a die which is provided therein with a section for forming a shaped configuration and a section for forming a body of a long element, the shaped configuration forming section lying at a front end portion of the die with respect to a direction in which the material is forced, the long element body forming section gradually increasing in inner diameter from the shaped configuration forming section to a rear end portion of the die; pressingly inserting a punch into the die to forge the material; and then pushing the forged material out of the die by a knock-out pin disposed in the front end portion of the die.

In the above method of forming a shaped configuration at an end of a long element according to the invention, the inner diameter of the die used gradually increases from the front end portion of the die to the rear end portion thereof with respect to the direction in which the material is forced. Therefore, the frictional resistance at the time when shaping the material by forcing the same into the die with the punch is remarkably reduced. As a result, the occurrence of defects in the forging decreases, the load for forcing the punch need not be made large and, hence, it becomes unnecessary to use a lubricant so that the accuracy in size can be improved.

Further, as the length for which the peripheral surface of the long element body and the die inner surface come into slide contact with each other when pushing the forged material by the knock-out pin decreases, the stroke of the knock-out pin for pushing the material out of the die can be shorted. Therefore, the load for the knock-out pin also need not be made large similarly to that for the punch, and there is no fear that the knock-out pin will break down.

Moreover, because the operative loads for the punch and the knock-out pin can be restrained and the stroke of the latter can be shortened, it is possible to reduce a hole forging apparatus in size.

DETAILED DESCRIPTION OF THE PREFERRED EMBODIMENT

Figure 2:
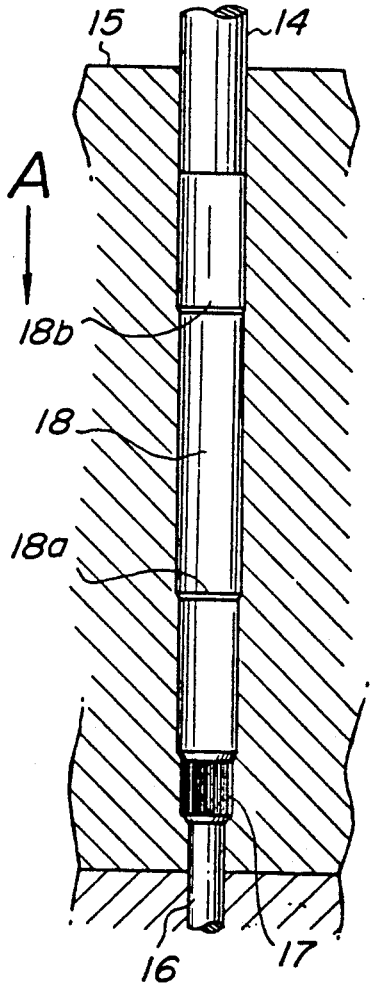
FIG. 2 is an enlarged view of the portion indicated by II in FIG. 1.
Figure 3:
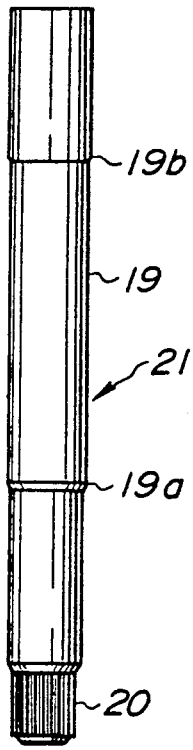
FIG. 3 is a side view of the material shaped by the apparatus.
Figure 4:
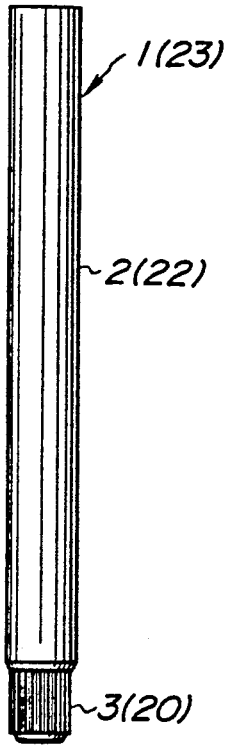
FIG. 4 is a side view showing the product of a completely shaped shaft.
Figure 5:
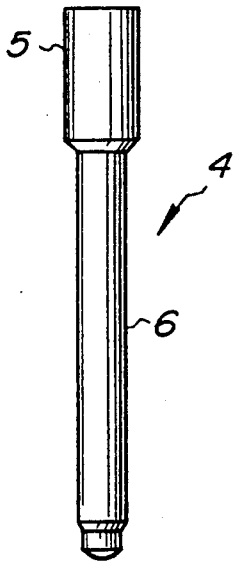
FIG. 5 (PRIOR ART)
FIGS. 5 and 6 are side views for explaining a conventional method of manufacturing a shaft, respectively.
Figure 6:
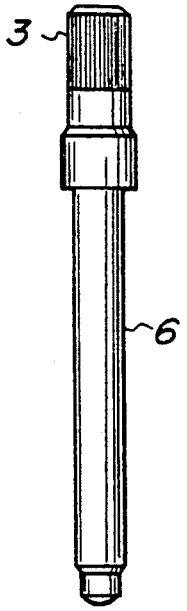
FIG. 6 (PRIOR ART)

Hereinafter, with reference to FIGS. 1-3, description will be made on the method of manufacturing the armature shaft of a stator motor according to an embodiment of the invention.

Figure 1:
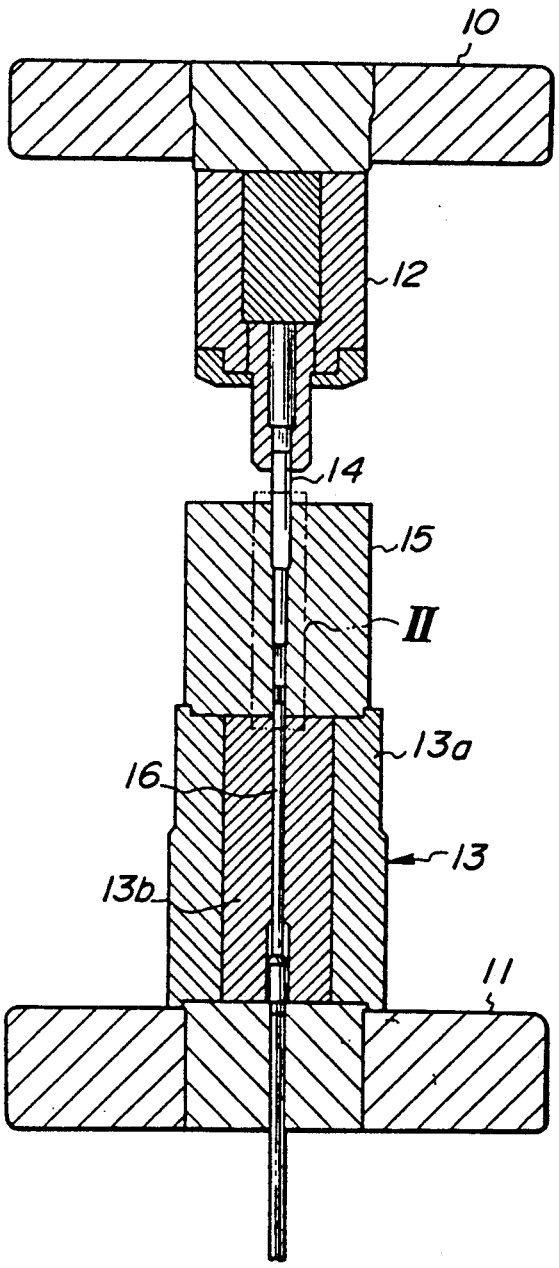
FIG. 1 is a schematic view showing the whole of a cold forging apparatus which is suited for carrying out the method according to an embodiment of the invention.

FIG. 1 shows a cold forging apparatus which is suited to bring the method into practice.

The apparatus includes upper and lower frames which are designated by reference numerals 10 and 11, respectively. A punch holder 12 and a die holder 13 are respectively fixed onto the upper and lower frames to be opposed to each other. A punch 14 is attached to the punch holder 12, and a die 15 is attached to the die holder 13. The die holder 13 is composed of an outer half 13*a* and an inner half 13*b*. The inner half 13*b* has a through hold axially formed in the center thereof. A knock-out pin is slidably inserted through the hole of the inner half 13*b* so that the upper end of the knock-out pin can be inserted in the die 15.

In this apparatus, the upper and lower frames are adapted to be movable to approach each other or come away from each other. A material which is a round metal rod of a uniform diameter is placed in the die when the upper and lower frames lie at a set position where they are away from each other. After the material has been placed in the die, by moving the upper and lower frames with high pressure in directions in which they approach each other, the punch 14 is inserted into the die 15 under the high pressure to forge the material. Returning the upper and lower frames 10 and 11 to the set position, the punch 14 comes out of the die and knock-out pin 16 is inserted in the die to push the forged material out of the die. By this operation, the forged material having the shape which corresponds to the inner space of the die can be produced.

The die 15 is made in a hollow column shape. In this die, as shown in FIG. 2, a shaped configuration forming section, or a gear forming section 17, is provided at a front end portion of the die as viewed in a direction in which the material is forced and which is indicated by an arrow A. The gear forming section 17 includes plural teeth which are formed in the inner periphery of the die to be arranged side by side in the circumferential direction thereof and extend in the material forcing direction, and has a diameter smaller than that of the material. Further, at least one step, although two steps 18*a* and 18*b* in the case of the embodiment, are provided in the die for gradually increasing the inner diameter thereof. The portion of the die where these steps are formed constitutes a long element body forming section, or a shaft body forming section 18.

The inner diameter of the die between the gear forming section 17 and the step 18*a* adjacent thereto is made slightly larger than the diameter of the material, and the diameters of the die between the step 18*a* and a rear end portion of the die are larger than the diameter of the die between the section 17 and the step 18*a*. Accordingly, in an initial state when placed in the die, the material can be inserted into the portion of the die between the section 17 and the step 18*a*. On the other hand, the knock-pin 16 is formed to have a diameter smaller than the addendum circle of the teeth of the gear forming section 17.

The material is placed in the die 15 having the above structure, and is extruded by the operation described above. A shaped material 21 obtained by this extruding has a shaft body 19 formed with steps 19*a* and 19*b*, and a gear 20 formed as a shaped configuration at the end of the shaft body, as shown in FIG. 3.

Subsequently, the shaft body 19 of the shaped material 21 is further shaped into a uniform diameter by cutting/polishing, pressing or the like. Thus obtained is a shaft 23 which has a shaft body 22 of a uniform diameter and a gear 20 provided at the front end of the shaft body.

According to the above method, owing to the provision of the steps 18*a* and 18*b*, the shaft body forming section 18 is gradually increased in inner diameter with respect to the direction in which the material is forced. Therefore, the frictional resistance of the material to the inner surface of the die 15 at the time of shaping, or at the time when extruding the material into the die 15 with the punch 14 is remarkably reduced. As a result, the occurrence of defects in the forging decreases, the load for forcing the punch 14 need not be made large and, hence, it becomes unnecessary to use a lubricant so that the accuracy in size can be improved.

Further, as the length for which the peripheral surface of the shaft body 19 and the inner surface of the die 15 come into slide contact with each other when pushing the forged material or shaped material 21 by the knock-pin 16 decreases, the stroke of the knock-out pin 16 for pushing the material out of the die 15 can be shortened. In addition, the load for the knock-out pin also need not be made large similarly to that for the punch 14, and there is no fear that the knock-out pin 16 will break down even if made of a small diameter.

Incidentally, although the description has been made on the method of forming a gear as a shaped configuration at an end of a shaft, the shaped configuration to be formed at the end is not limited solely to the gear, and serrations or an angular shape or a cylindrical shape may alternatively be formed. Further, the inner surface of the die may be formed in a tapered shape instead of the stepped shape.

Moreover, it is needless to say that the long element is not limited to the armature shaft for use in a starter motor and the method of the invention is applicable to the constituent member of another device.

What is claimed is:

1. A method of forming a shaped configuration at an end of a long element, comprising the steps of:

(a) placing a material with a uniform cross section along its length in an inside of a die which is provided therein with a section for forming a shaped configuration and a section for forming a body of a long element, said shaped configuration forming section lying at a front end portion of said die with respect to a direction in which the material is forced, said long element body forming section having step shaped inner surfaces, the diameters of the inner surfaces gradually increasing from the shaped configuration section to a rear end portion of said die so as to provide a gap between an outer surface of said material and an inner surface of said die gradually increasing from said shaped configuration section to said rear end portion of said die when said material is placed inside said die, said material having a length smaller than that of said long element body forming section and a diameter larger than that of said shaped configuration forming section, wherein when said material is placed within said die the forward end of said material abuts against the forward end of said long element body forming section;

(b) pressingly inserting a punch into said die so as to forge said material to extrude the front end portion thereof into the shaped configuration forming section, thereby forming a shaped configuration at the forward end of the material and simultaneously forcing the rest of the material to bulge according to the shape of the inner surfaces of the long element body forming section of the die; and (c) subsequently pushing said forged material out of said die by a knock-out pin which is inserted in said die from an opposite direction to the direction in which said material is extruded.

2. A method according to claim 1, further comprising the step of finishing another part of the forged material than a part thereof shaped by said shaped configuration forming section so that said other part of the forged material has a uniform diameter.

3. A method according to claim 1, wherein said long element is a armature shaft of a starter motor for an automobile, and said shaped configuration is a gear to be formed at an end of said armature shaft.

4. A method according to claim 1, wherein said long element is an elongated metallic b ar having a length and a substantially uniform diameter through the length.

5. A method according to claim 1, wherein a length of the stepped portion is predetermined so that the knock-out pin can push the forged material out of said die without buckling.

* * * * *

UNITED STATES PATENT AND TRADEMARK OFFICE

CERTIFICATE OF CORRECTION

PATENT NO. : 5,211,048

DATED : May 18, 1993

INVENTOR(S) : Katsuo Takahara, et al.

It is certified that error appears in the above-indentified patent and that said Letters Patent is hereby corrected as shown below:

Column 6, line 15, claim 4, "b ar" should read --bar--.

Signed and Sealed this

Fourteenth Day of February, 1995

Bruce Lehman

*Attest:*

BRUCE LEHMAN

*Attesting Officer*

*Commissioner of Patents and Trademarks*